US011785984B2

(12) United States Patent
Liu

(10) Patent No.: US 11,785,984 B2
(45) Date of Patent: Oct. 17, 2023

(54) HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 412 days.

(21) Appl. No.: 17/096,924

(22) Filed: Nov. 12, 2020

(65) Prior Publication Data

US 2021/0360966 A1 Nov. 25, 2021

(30) Foreign Application Priority Data

May 21, 2020 (CN) ..... 202010434273.2
May 21, 2020 (CN) ..... 202020859764.7

(51) Int. Cl.

| | |
|---|---|
| ***A24F 1/30*** | (2006.01) |
| ***A24F 1/32*** | (2006.01) |
| ***A24F 1/14*** | (2006.01) |
| ***A24F 40/57*** | (2020.01) |
| ***A24F 40/465*** | (2020.01) |
| ***A24F 40/485*** | (2020.01) |
| ***A24F 40/10*** | (2020.01) |
| ***A24F 40/20*** | (2020.01) |
| ***A24F 40/60*** | (2020.01) |
| ***A24F 40/90*** | (2020.01) |

(52) U.S. Cl.

CPC ..... *A24F 1/30* (2013.01); *A24F 1/14* (2013.01); *A24F 1/32* (2013.01); *A24F 40/465* (2020.01); *A24F 40/57* (2020.01); *A24F 40/10* (2020.01); *A24F 40/20* (2020.01); *A24F 40/485* (2020.01); *A24F 40/60* (2020.01); *A24F 40/90* (2020.01)

(58) Field of Classification Search

CPC ..... A24F 1/30; A24F 40/465; A24F 5/10
See application file for complete search history.

(56) References Cited

U.S. PATENT DOCUMENTS 2,815,030 A * 12/1957 Wenger ..... A24F 1/30
131/173

FOREIGN PATENT DOCUMENTS

CH WO 2019/003116 A1 * 1/2019 ..... A24F 1/30

* cited by examiner

*Primary Examiner* — Michael J Felton
*Assistant Examiner* — Ronnie Kirby Jordan
(74) *Attorney, Agent, or Firm* — MATTHIAS SCHOLL P.C.; Matthias Scholl

(57) ABSTRACT

A hookah, including a pipe body, a handle, a high-frequency heater, a smoke filter, and a cigarette holder. The high-frequency heater is disposed in the pipe body. The smoke filter and the cigarette holder are disposed in the handle.

11 Claims, 4 Drawing Sheets

HOOKAH

CROSS-REFERENCE TO RELATED APPLICATIONS

Pursuant to 35 U.S.C. § 119 and the Paris Convention Treaty, this application claims foreign priority to Chinese Patent Application No. 202010434273.2 filed May 21, 2020, and to Chinese Patent Application No. 202020859764.7 filed May 21, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq, 245 First Street, 18th Floor, Cambridge, Mass. 02142.

BACKGROUND

The disclosure relates to a hookah.

A hookah is a single- or multi-stemmed instrument for heating or vaporizing and then smoking either tobacco, flavored tobacco, or sometimes cannabis, hashish, and in the past opium. The smoke is passed through a water basin often glass-based before inhalation. A conventional hookah is ignited by open tire, and the smoke volume produced by the hookah is unregulatable.

SUMMARY

The disclosure provides a hookah comprising a pipe body, a handle, a high-frequency heater, a smoke filter and a cigarette holder. The high-frequency heater is disposed in the pipe body, and the smoke filter and the cigarette holder are disposed in the handle.

In a class of this embodiment, the high-frequency heater comprises a heating cup and an electromagnetic coil. The electromagnetic coil is disposed around the heating cup. The heating cup is configured to accommodate a tobacco material. When in use, an alternating current is introduced to the magnetic induction coil, and a magnetic induction effect is generated, so that the heating cup is heated and the heat is transferred to the tobacco material whereby the tobacco material is heated and smoke is produced.

In a class of this embodiment, the smoke filter comprises a first tube and a second tube. The first tube comprises a first end and a second end, and the second tube comprises a first end and a second end. The first end of the first tube is connected to the pipe body, and the second end of the first tube is disposed in the handle. The first end of the second tube is disposed in the handle, and the second end of the second tube is connected to the cigarette holder. The smoke, when passing through the handle, is filtered by the water in the handle, and is then discharged from the second tube to the cigarette holder.

In a class of this embodiment, the first tube is an inverted U-shaped tube. The second end of the first tube is close to a first end of the handle that is connected to the pipe body.

In a class of this embodiment, the second tube is U-shaped. The first end of the second tube is close to a second end of the handle that is connected to the cigarette holder.

In a class of this embodiment, the hookah further comprises a seal component configured to be inserted into the first end of the second tube to prevent the smoke from entering the second tube.

In a class of this embodiment, the heating cup is replaceable.

In a class of this embodiment, the hookah further comprises a toggle switch configured to change a heating power of the heating cup each time it is pressed, so as to heat different smoking materials.

In a class of this embodiment, the heating cup comprises glass, ceramic, quartz, or crystal material comprising an inlayed metal.

In a class of this embodiment, the hookah further comprises a glass sleeve disposed between the heating cup and the electromagnetic coil. The glass sleeve is configured to protect the electromagnetic coil and hold the heating cup in place.

In a class of this embodiment, the heating cup comprises a top opening and a blind bottom end. The heating cup is configured to hold liquid smoking materials.

In a class of this embodiment, the heating cup comprises a plurality of through holes on the top or at the bottom thereof. The heating cup is configured to hold solid smoking materials.

In a class of this embodiment, the hookah further comprises a first cover comprising an inner wall, a first button comprising a first hole, and a silicone spring. The first button is disposed on the first cover. When the first button is pressed down, the silicone spring rebounds and pushes the first button to move up and down. The first hole is gradually covered by the inner wall as the first button is pressed down. The uncovered area of the first hole determines the amount of smoke passing through the first hole.

In a class of this embodiment, the hookah further comprises a temperature sensor. The temperature sensor is configured to transmit a signal to reduce an output power of the hookah when a preset temperature is detected.

In a class of this embodiment, the hookah further comprises a third tube, and a control panel comprising an airflow switch. When the gas passes through the third tube, the airflow switch is triggered, the power supply is connected and the high-frequency heater starts to work.

In a class of this embodiment, the hookah further comprises a charging panel and a battery. The battery is rechargeable, soldered to the output terminal of the charging panel, and disposed at the bottom of the pipe body.

The following advantages are associated with the hookah of the disclosure:

1. The hookah comprises a high-frequency heater in which the conductive container produces heat through electromagnetic induction to heat the smoking materials.
2. The hookah comprises a first button configured to regulate the flow of the air. The first button is pressed down to cause a change in the flow area of the first hole, thereby controlling the amount of the air passing through the first hole.
3. The hookah comprises a toggle switch configured to change a heating power of the heating cup each time it is pressed, so as to heat different smoking materials.
4. The hookah comprises a heating cup which is replaceable to meet the demands of heating the smoking materials in different phases.

DETAILED DESCRIPTION

To further illustrate, embodiments detailing a hookah are described below. It should be noted that the following embodiments are intended to describe and not to limit the disclosure.

Figure 1:
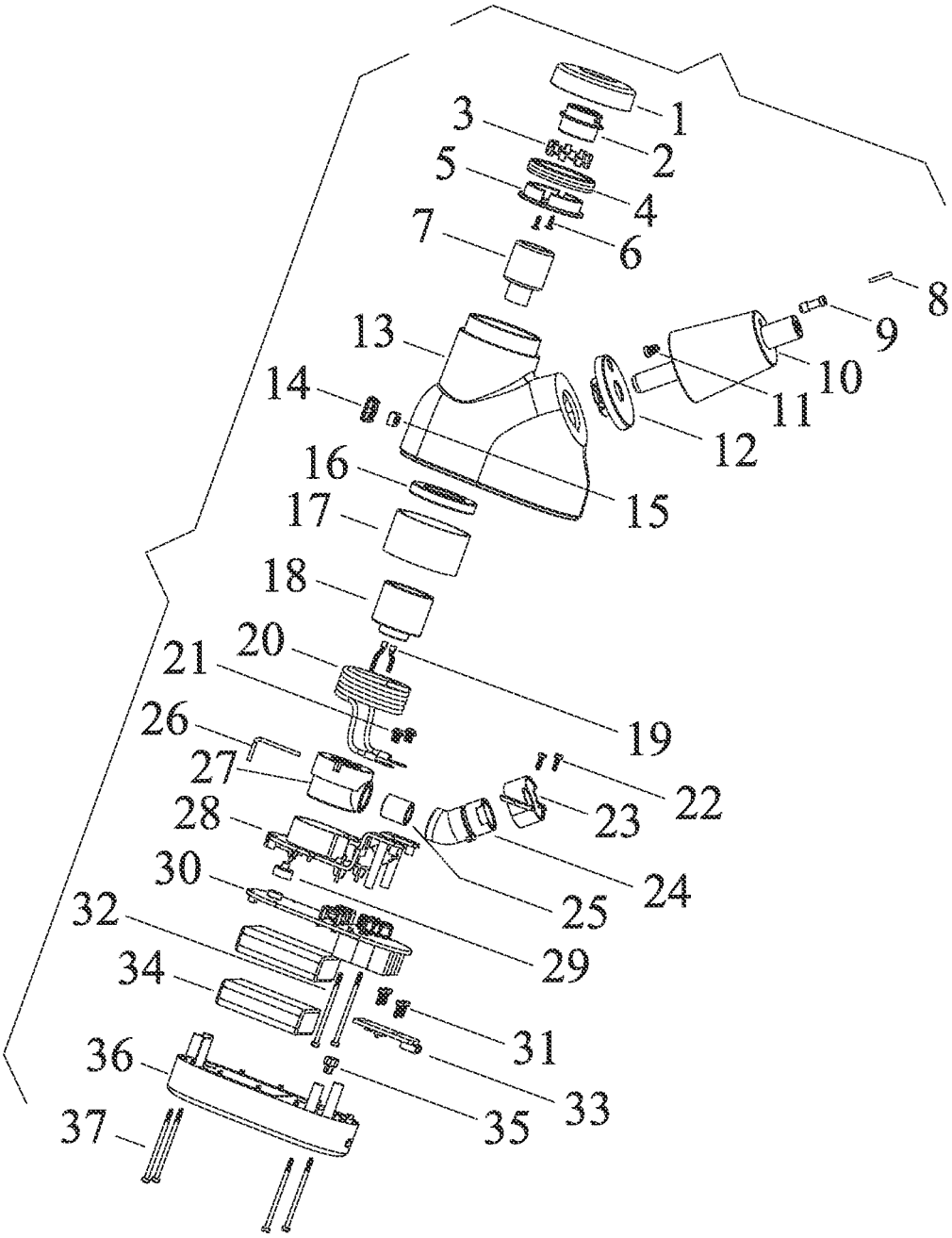
FIG. 1 is an exploded view of a hookah in accordance with one embodiment of the disclosure.
Figure 2:
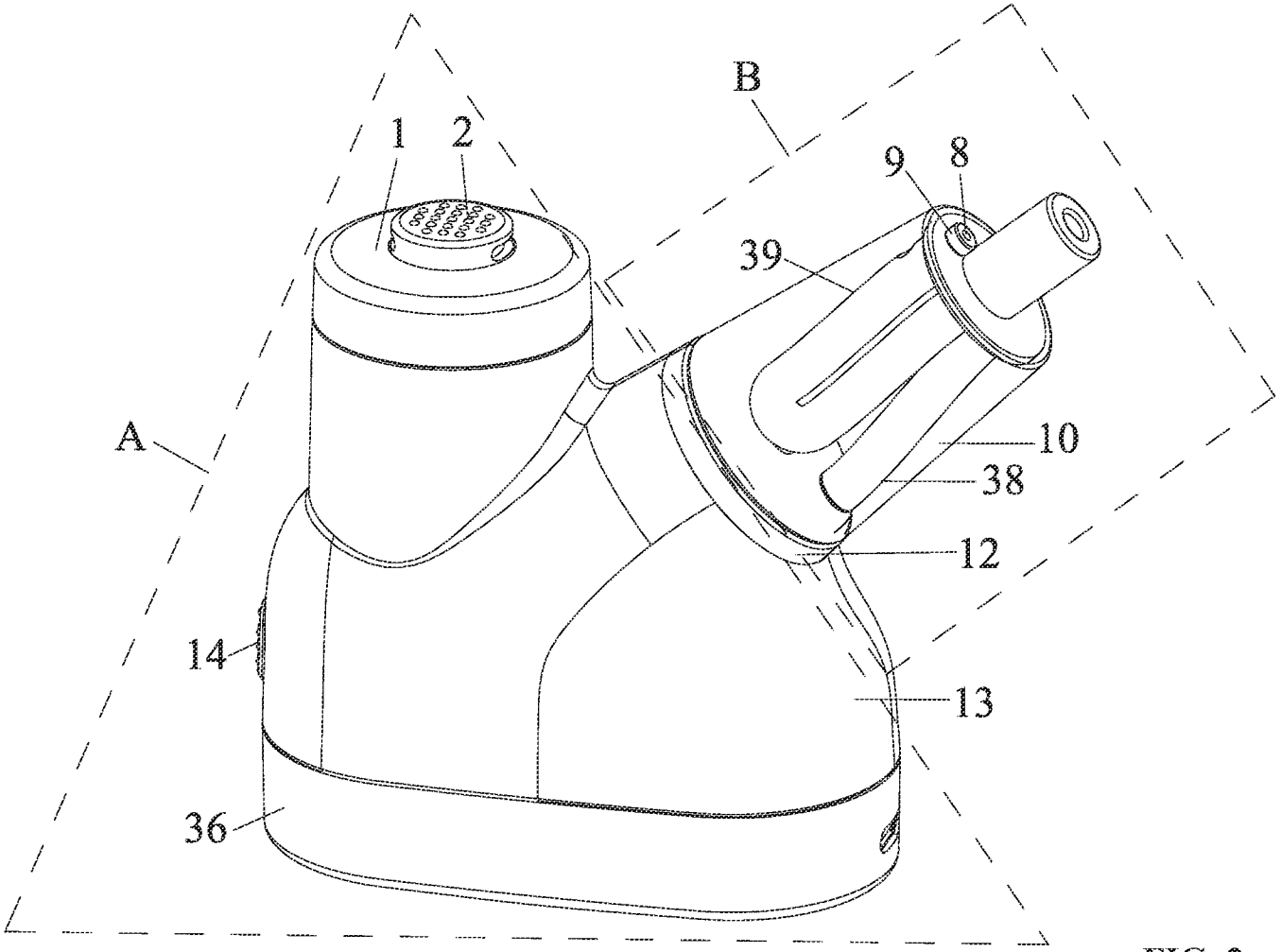
FIG. 2 is a perspective view of a hookah in accordance with one embodiment of the disclosure.
Figure 3:
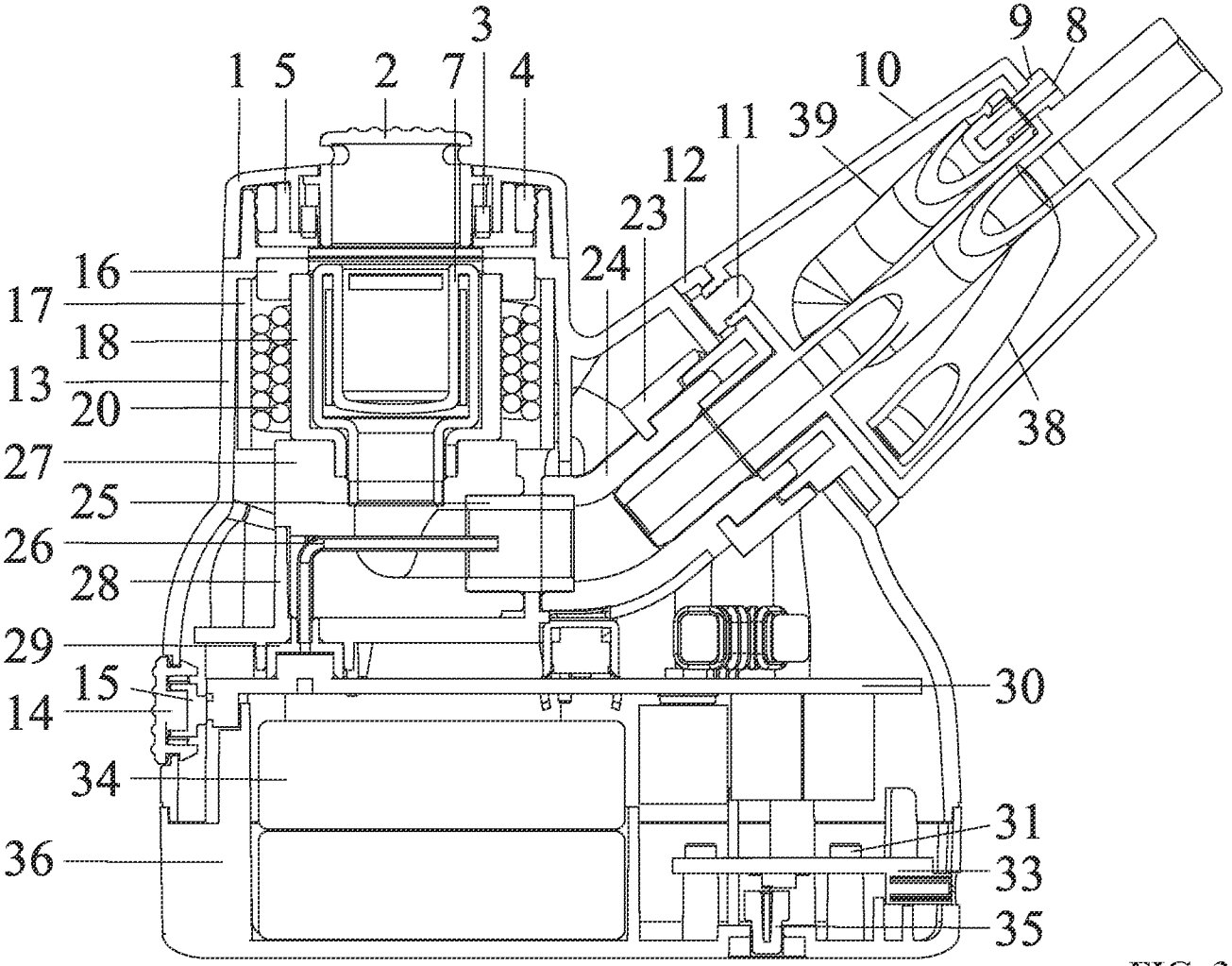
FIG. 3 is a sectional view of a hookah in accordance with one embodiment of the disclosure.
Figure 4:
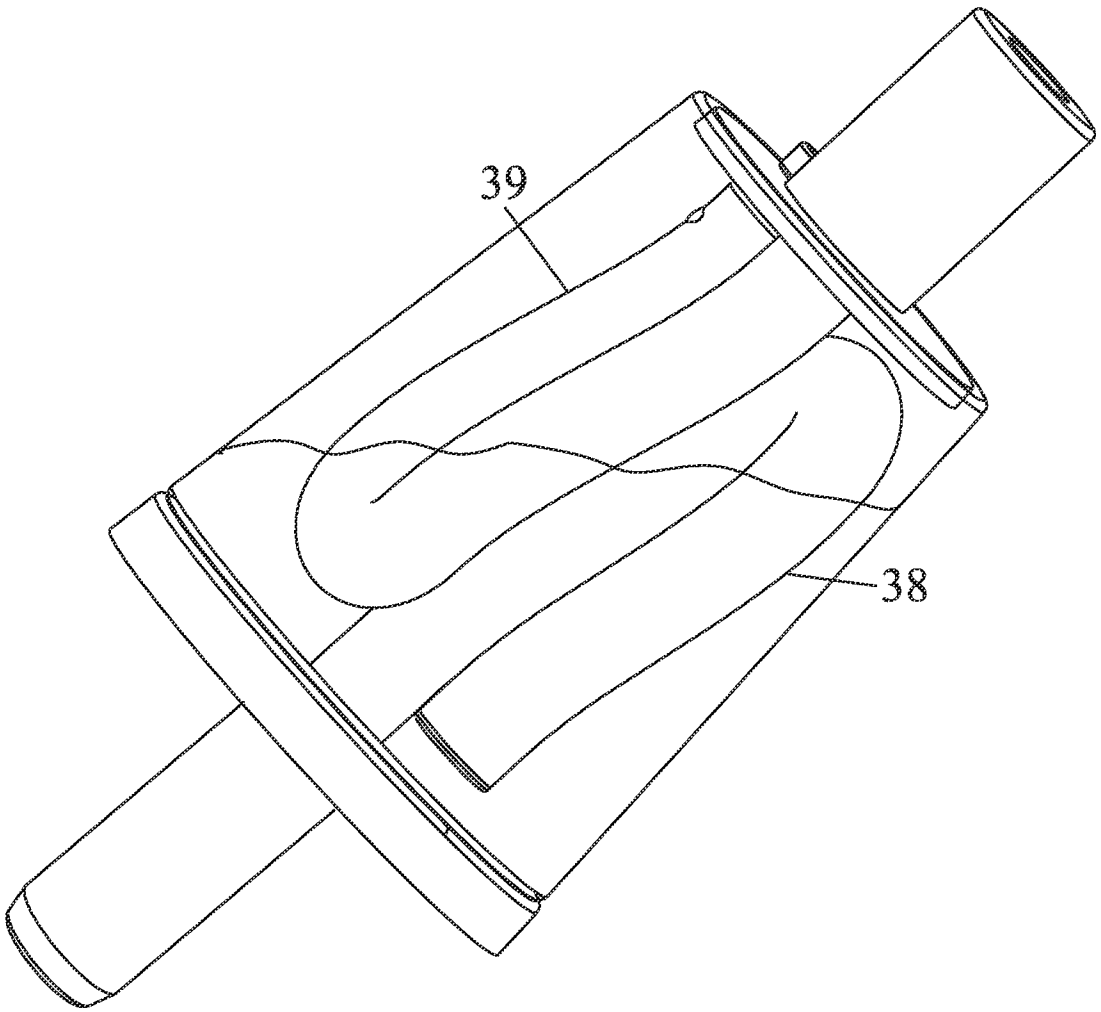
FIG. 4 is a partial enlarged view of a smoke filter of a hookah in accordance with one embodiment of the disclosure.

As shown in FIGS. 1-4, the disclosure provides a hookah comprising a pipe body A and a handle B. The pipe body A comprises a high-frequency heater, and the handle B comprises a smoke filter and a cigarette holder.

The hookah comprises a first cover 1, comprising an inner wall, a first button 2 comprising a first hole, a silicone spring 3, a seal ring 4, a retaining ring 5, a first screw 6, a heating cup 7 comprising a plurality of through holes, a pin 8, a silicone plug 9, a glass body 10, a decorative ring 12, a main body 13, a second button 14, a silicone gasket 15, a seal gasket 16, a thermal insulating wool 17, a glass sleeve 18, a temperature sensor 19 comprising a first lead wire, an electromagnetic coil 20 comprising a second lead wire, a second screw 21, a third screw 22, a locating ring 23 comprising a second inner air duct, an adapter 24, a fourth tube 25, a third tube 26, a locating base 27 comprising an first inner air duct, a fixing base 28, a second cover 29, a control panel 30, a fourth screw 31, a fifth screw 32, a battery 34, a toggle switch 35, a bottom base 36, a sixth screw 37, a first tube 38, and a second tube 39. The seal ring 4 is disposed on the retaining ring 5 to create a seal. The first button 2 is disposed on the first cover 1. The silicone spring 3 is disposed under the first button 2. When the first button 2 is pressed down, the restoring force of the silicone spring 3 returns the first button 2 to its former position. The first hole is gradually covered by the inner wall as the first button 2 is pressed down. The uncovered area of the first hole determines the amount of smoke passing through the first hole. The retaining ring 5 is secured to the bottom of the first cover 1 with a first screw 6. The first cover 1 is disposed on the main body 13. The glass sleeve 18 is configured to receive the heating cup 7. The electromagnetic coil is disposed around the glass sleeve 18. The thermal insulating wool 17 is configured to wrap the electromagnetic coil 20 so as to protect the other components from the damage caused by electromagnetic induction heating. The seal gasket 16 is disposed on the top of the electromagnetic coil 20. The control panel 30 comprises a temperature control panel, an output terminal circuit, an airflow switch, a slot, and a switch button. The temperature sensor 19 is disposed on the bottom of the glass sleeve 18, and the first lead wire is secured to the temperature control circuit. The electromagnetic coil is disposed on the locating base 27, and the second lead wire is secured to the output terminal circuit with a second screw 21. The locating base 27 is disposed on the fixing base 28. The second cover 29 is disposed on the airflow switch. One end of the third tube 26 is inserted into the second cover 29, and another end is completely inserted into the first inner air duct so as to guide a gas flow and to separate the gas from the liquid produced by heating smoking materials. When the gas flow into the first inner air duct and passes through the third tube 26, the airflow switch is turned on to make a connection in the electrical circuit and to make the high-frequency heater work. The control panel 30 is secured to the fixing base 28 with the fifth screw 32. The fourth tube 25 is connected to one side of the locating base 27 so as to communicate with the first inner air duct. The adapter 24 is connected to the fourth tube 25 so as to guide the gas flow. The locating ring 23 is connected to the adapter 24 and secured to the fixing base 28 with a third screw 22. The fixing base 28 and other components disposed thereon are fixed in the main body 13. The second button 14 is disposed on the silicone gasket 15 and fixed in the slot of the main body 13. The silicone gasket 15 is disposed on the switch button of the control panel. The decorative ring 12 comprises a second hole and a third hole. The decorative ring 12 is disposed at the bottom of the glass body 10 and secured to the locating ring 23 in the main body 13. The seal plug 11 is inserted into the third hole to block the water flow, or the water flows out of the glass body 13 when the seal plug 11 is removed. The glass body 10 comprises a first tube 38 and a second tube 39. The first tube 38 comprises a first end and a second end, and the second tube 39 comprises a first end and a second end. The first end of the first tube 38 is connected to the locating ring 23 through the second hole so as to introduce gas into the water for filtering. The gas flows through the first hole of the first button 2 into the heating cup 7. The smoke produced by heating smoking materials flows into the first inner air duct of the locating base 27 via the plurality of through holes or the gap between the heating cup 7 and the glass sleeve 18. As used herein, the term "smoking materials" refer to the materials that give out smoke on burning, such as e-liquid, hookah paste, and tobacco. The gas passes sequentially through the fourth tube 25, the adapter 24, and the second inner air duct. The gas flows through the first tube 38 into the water in the glass body 10 for filtering, and is then discharged through the through hole 39 to the cigarette holder for user's inhaling. The pin is inserted into the silicone plug 9 so as to increase the hardness of the silicone plug 9. The silicone plug 9 is inserted at the first end of the second tube 39 so as to prevent the water from flowing into the second tube 39 when the hookah is placed vertically or turned upside down. The silicone plug 9 is removed when a user is smoking. The charging panel 33 is secured to the bottom base 36 with the fourth screw 31. The battery 34 is disposed on the bottom base 36, and soldered to the output terminal of the charging panel 33 as well as the input terminal of the control panel 30. The toggle switch 35 is disposed on the charging panel 33, inserted into and extends out of the bottom base 36. The toggle switch 35 is configured to change the beating power of the beating cup each time it is pressed so as to heat the smoking materials in the heating cup 7. The bottom base 36 is secured at the bottom of the main body 13 with a sixth screw 37.

It will be obvious to those skilled in the art that changes and modifications may be made, and therefore, the aim in the appended claims is to cover all such changes and modifications.

The invention claimed is:

1. A hookah comprising: a pipe body, a handle, a high-frequency heater, a smoke filter, a mouthpiece, a seal component, a first cover comprising an inner wall, a first button comprising a first hole, and a silicone spring; wherein:

the high-frequency heater is disposed in the pipe body;

the smoke filter and the mouthpiece are disposed in the handle;

the high-frequency heater comprises a heating cup and an electromagnetic the electromagnetic coil is disposed around the heating cup;

the heating cup is configured to accommodate a tobacco material; when in use, an alternating current is introduced to the magnetic induction coil, and a magnetic induction effect is generated, so that the heating cup is heated and the heat is transferred to the tobacco material whereby the tobacco material is heated and smoke is produced;

the smoke filter comprises a first tube and a second tube;

the first tube comprises a first end and a second end;

the second tube is U-shaped, and comprises a first end and a second end;

the first end of the first tube is connected to the pipe body, and the second end of the first tube is disposed in the handle;

the first end of the second tube is disposed in the handle, and the second end of the second tube is connected to the mouthpiece; the smoke, when passing through the handle, is filtered by water in the handle, and is then discharged from the second tube to the mouthpiece;

the seal component is configured to be inserted into the first end of the second tube to prevent the water from entering the second tube; and the first button is disposed on the first cover; when the first button is pressed down, the silicone spring rebounds and pushes the first button to move up and down; the first hole is gradually covered by the inner wall as the first button is pressed down; the uncovered area of the first hole determines an amount of air passing through the first hole.

2. The hookah of claim 1, wherein the first tube is an inverted U-shaped tube.

3. The hookah of claim 1, wherein the heating cup is replaceable.

4. The hookah of claim 1, wherein the hookah further comprises a toggle switch configured to change a heating power of the heating cup each time the toggle switch is pressed, so as to heat different smoking materials.

5. The hookah of claim 1, wherein the heating cup comprises glass, ceramic, quartz, or crystal material comprising an inlayed metal.

6. The hookah of claim 4, wherein the hookah further comprises the glass sleeve is configured to protect the electromagnetic coil and hold the heating cup in place.

7. The hookah of claim 5, wherein the heating cup comprises a top opening and a blind bottom end; the heating cup is configured to hold liquid smoking materials.

8. The hookah of claim 5, wherein the heating cup comprises a plurality of through holes on a top end and a bottom end thereof; the heating cup is configured to hold solid smoking materials.

9. The hookah of claim 1, wherein the hookah further comprises a temperature sensor; the temperature sensor is configured to transmit a signal to reduce an output power of the hookah when a preset temperature is detected.

10. The hookah of claim 9, wherein the hookah further comprises a third tube, and a control panel comprising an airflow switch; when the gas passes through the third tube, the airflow switch is triggered, a power supply is connected and the high-frequency heater starts to work.

11. The hookah of claim 1, wherein the hookah further comprises a charging panel and a battery; the battery is rechargeable, soldered to an output terminal of the charging panel, and disposed at a bottom of the pipe body.

* * * * *